United States Patent [19]

Hay et al.

[11] 4,417,728

[45] Nov. 29, 1983

[54] TRAINING APPARATUS FOR RACKET SPORTS

[75] Inventors: Eric Hay, Johanneshov; Anders Nordstrom, Kungsangen, both of Sweden

[73] Assignee: Esselte Studium AB, Stockholm, Sweden

[21] Appl. No.: 147,233

[22] Filed: May 6, 1980

Related U.S. Application Data

[63] Continuation-in-part of Ser. No. 252,979, filed as PCT SE80/00045, Feb. 13, 1980, published as WO80/01650, Aug. 21, 1980, & 102(e) date Apr. 29, 1980.

[51] Int. Cl.[3] ..... A63B 69/38

[52] U.S. Cl. ..... 273/29 A; 273/342; 273/396; 273/407

[58] Field of Search ..... 273/29 A, 29 G, 26 A, 273/176 B, 177 A, 177 B, 181 R, 181 F, 181 J, 181 K, 182 R, 35 R, 55 B, 29 B, 30, 342, 396, 407

[56] References Cited

U.S. PATENT DOCUMENTS

| | | | |
|---|---|---|---|
| 920,907 | 5/1909 | Bolton | 273/181 F |
| 1,086,067 | 2/1914 | McMellan | 273/26 A |
| 1,540,670 | 6/1925 | Vidmer | 273/181 F |
| 1,658,097 | 2/1928 | Pierce | 273/26 A |
| 1,745,201 | 1/1930 | Alston | 273/181 R |
| 2,161,463 | 6/1939 | Frost | 273/30 |
| 2,895,737 | 7/1959 | Blees | 273/26 A |
| 3,062,544 | 11/1962 | Viets | 273/30 |
| 3,180,643 | 4/1965 | Kallai | 273/29 A |
| 3,427,026 | 2/1969 | Mahoney | 273/29 B |
| 3,820,787 | 6/1974 | Heinbigner | 273/55 B |
| 4,239,235 | 12/1980 | Torres . | |

FOREIGN PATENT DOCUMENTS

| | | | |
|---|---|---|---|
| WO81/01521 | 6/1981 | PCT Int'l Appl. | 273/30 |

*Primary Examiner*—Richard C. Pinkham
*Assistant Examiner*—T. Brown
*Attorney, Agent, or Firm*—Behr & Adams

[57] ABSTRACT

A rebound apparatus for practicing striking a ball with a racket. The apparatus has an elongated rectangular frame which is mounted on a base for pivotal adjustment about a horizontal axis. Mounted on the frame is a flexible material which is relatively loose along the width of the frame and relatively taut along the length of the frame. The upper end of the frame is curved out of the plane of the main portion of the frame, and this upper end supports a ball rebound surface. The flexible material may be secured at its upper end to the rebound surface. The length of the frame is adjustable. In use, a ball when hit by a racket will strike the flexible material, rebound upwardly against the ball rebound surface, and then rebound again in a direction back toward the player who hit the ball.

11 Claims, 11 Drawing Figures

TRAINING APPARATUS FOR RACKET SPORTS

RELATED APPLICATIONS

This application is a continuation-in-part of Ser. No. 252,979 filed as PCT SE80/00045, Feb. 13, 1980, published as WO 80/01650, Aug. 21, 1980, § 102(e) dated Apr. 29, 1980.

BACKGROUND OF THE INVENTION

1. Field of the Invention

The present invention relates to a training apparatus for racket sports and, in particular, to a training apparatus for tennis and squash, which permits an individual to improve his skills with practice in a relatively small area.

2. Description of the Relevant Art

In order to improve the skills of an individual engaging in racket sports such as tennis, squash and the like many different types of training equipment have been devised. One such device includes a flat rigid surface disposed as right angles to the horizontal. An individual strikes a ball which impinges upon the hard surface and the ball bounces off the surface and returns to the individual to be hit again and again. The timing of the returned ball utilizing this type of device in a confined area bears no relationship to the actual response time required when engaging in the actual sport thus, its training usefulness is limited.

Another type of device utilizes a tennis ball which has affixed thereto an elastic band that in turn is connected to a weight resting on the ground. Striking the ball with the racket causes the ball to travel a distance determined by the length of the elastic band and its resiliency and is returned to the individual striking the ball. However, the return path of the ball bears no relation to the actual return on a court in which the game is played. Thus, each time the ball is struck it must be lifted and hit again by the individual, thereby being of limited training value.

Still another type of training device is disclosed in Swedish Pat. No. 355,727 that utilizes a curved shock absorbing surface toward which the ball is aimed. The shock absorbing surface absorbs most of the ball's energy and deflects it downwardly toward a rebound surface whereupon it is returned to the individual who may keep the ball in motion by repeatingly striking it each time it is returned to him. Here again, the training value is limited since the time of return of the ball bears no relationship to the actual time of return in a conventional game of squash or tennis.

SUMMARY OF THE INVENTION

The present invention overcomes the shortcomings found in the prior art by providing a type of training equipment which may be utilized to improve the skills of an individual. The apparatus utilizes a lightweight frame and a flexible cloth which absorbs the kenetic energy of a ball impinging thereon and is sloped to cause the ball to move upwardly until it strikes against a rebound surface wherein it then returns to the individual to be hit again and again. The time delay caused by the cloth absorbing the kenetic energy of the ball and the travel time until it strikes the rebound surface can be made to approximate the normal return time found in tennis and squash when returned by an opposing player. The return speed of the ball is essentially independent of the speed of the ball when it is struck or it contacts the cloth.

A training apparatus for racket sports such as tennis, squash or the like, according to the principles of the present invention, comprises a frame having a curved portion at the upper end thereof. The frame is adjustable in length and is provided with a support portion for disposing the frame at a plurality of angles from a horizontal support surface. A rebound surface is disposed across the width of the frame at the distal edge of the curved portion. A flexible material is attached to the rebound surface and extends loosely across the width and length of the frame. The material is also attached to the lower corners of the frame and its longitudinal tautness is adjusted by adjusting the frame length.

The foregoing and other objects and advantages will appear from the description to follow. In the description reference is made to the accompanying drawing which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and the structural changes may be made without departing from the scope of the invention. The following detailed description is, therefore, not to be taken in a limiting sense, and the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
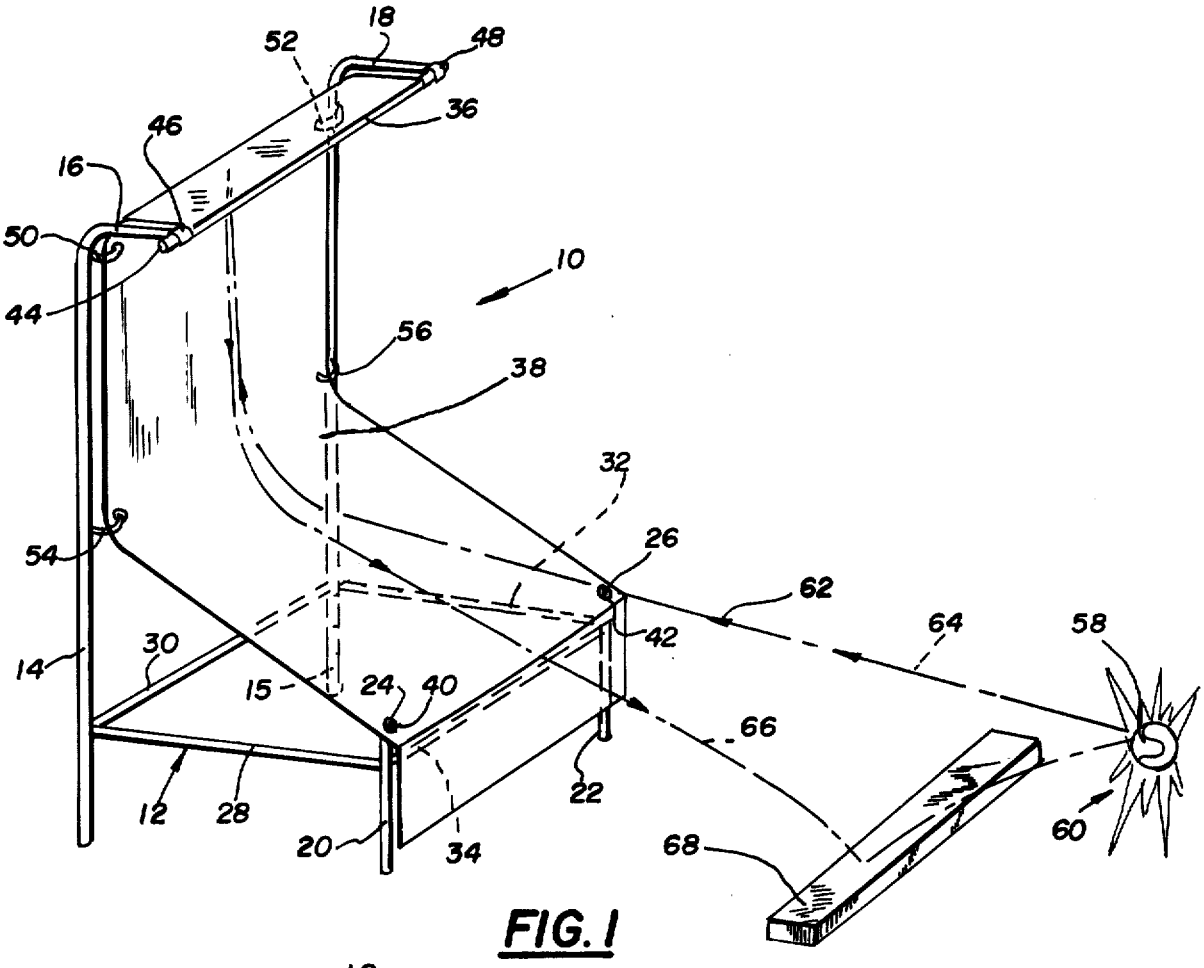
FIG. 1 is a pictorial representation in perspective of a training apparatus, according to the principles of the present invention.
Figure 2:
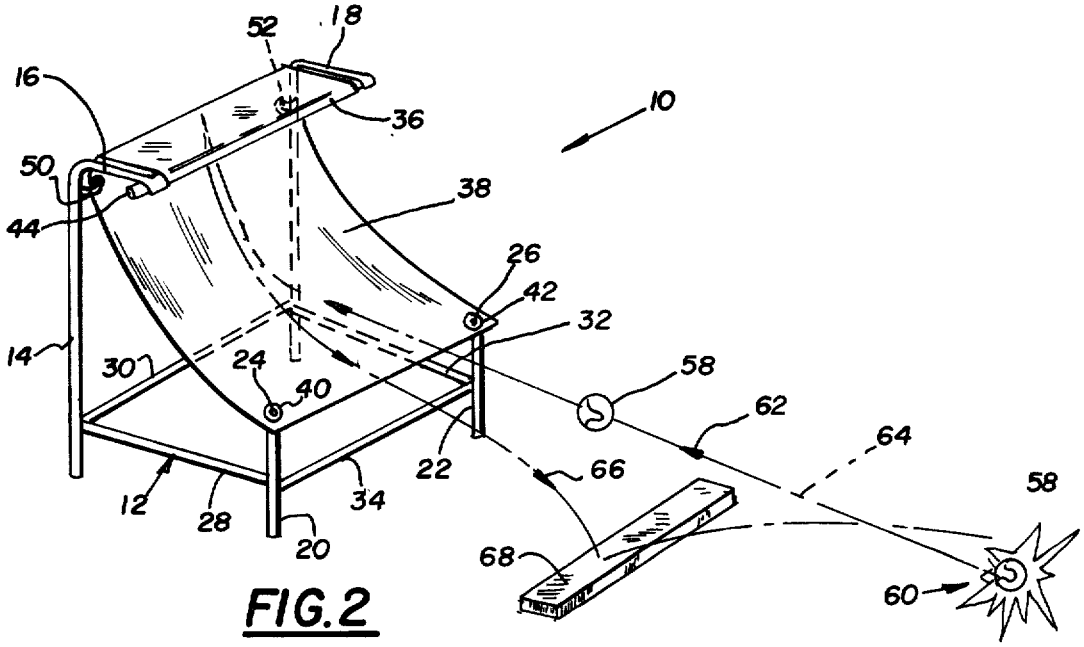
FIG. 2 is a pictorial representation in perspective of an embodiment similar to FIG. 1 slightly modified to provide a different response time for the returning ball.

Referring now to the figures and in particular to FIGS. 1 and 2, which shows one embodiment of the training apparatus 10 utilized by an individual to improve his strokes in racket games such as tennis, squash or the like. The training apparatus includes a frame 12 consisting of two elongated vertical members 14 and 16 disposed in an upright position and having a curved portion 16 and 18, respectively, at the upper end thereof. Two additional vertical members 20 and 22 are provided forward of members 14 and 16. Vertical members or legs 20 and 22 are preferably much shorter than members 14 and 16. The upper end of members 20 and 22 are provided with a hook-shaped retaining member 24 and 26 whose function will be discussed shortly. Horizontal support braces 28, 30, 32 and 34 rigidly support the vertical members 14, 16 22 and 24 to form a rigid foundation.

A rebound surface 36 extends horizontally between curved portions 16 and 18 of the vertical members 14 and 16 and is affixed thereto in a conventional manner. A flexible member 38 is affixed to the rebound surface along essentially its entire length in a conventional manner. It extends longitudinally along the frame and is retained by retaining members 24 and 26 as they pass through the eyelets 40 and 42 provided in the flexible member 38. The flexible member 38 may be fabricated of a heavy canvas cloth material capable of standing the impact that will be explained hereinafter. This material may be manufactured of a relatively durable cloth or tightly woven netting. Also suitable would be a reinforced plastic or similar material.

It is also to be noted that the rebound surface may consist of a rigid material such as wood or steel or it may also be fabricated from a resilient material such as hard rubber or the like. The curved portion 16 and 18 of vertical members 14 and 15 may also be fabricated from a resilient material if desired.

In the embodiment shown in FIGS. 1 and 2 the rebound surface 36 consists of a cylindrically shaped rod 44 which has the flexible member 38 affixed thereto in a conventional manner. The rod 44 is retained in the curved portion 16 and 18 at the distal end thereof by any conventional means such as, for example, by a hollow circular shaped opening 46 and 48 provided at the distal end of curved portions 16 and 18.

The flexible member 38 may be pulled rearwardly towards vertical members 14 and 15 with the aid of hook-shaped members 50, 52, 54 and 56 which holds the flexible member in a relatively taut position. In FIG. 2 hook-shaped retaining members 52 and 54 are not utilized thereby providing for a different return angle, speed and timing of the returned ball.

A ball 58 being struck by a racket at point 60 will travel in the direction of arrow 62 along the path 64 indicated by the broken line. The ball will impact the flexible member 38 and because of the sloped portion thereof will move in an upwardly direction until its force can be absorbed by the rebound surface 36. The flexible member or cloth 38 will absorb a great deal of momentum (kenetic energy) of the ball when it impinges thereon with the remaining energy capable of being absorbed by the rebound surface 36. The ball will then follow the return path 66 shown by the smaller broken line and will strike a second rebound surface 68 where it will rebound to the general area of impact 60 where an individual may strike the ball again and keep it in play again and again, thereby providing the opportunity for the individual to improve his skill.

Figure 3:
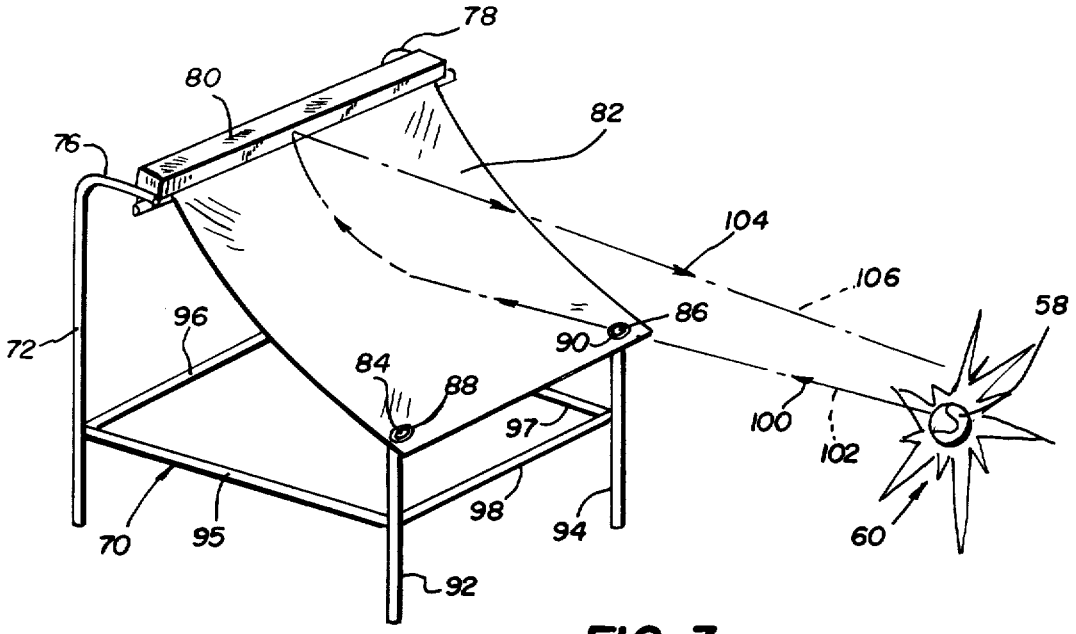
FIG. 3 is an alternate embodiment of the present apparatus capable of providing a modified response time for the ball.
Figure 4:
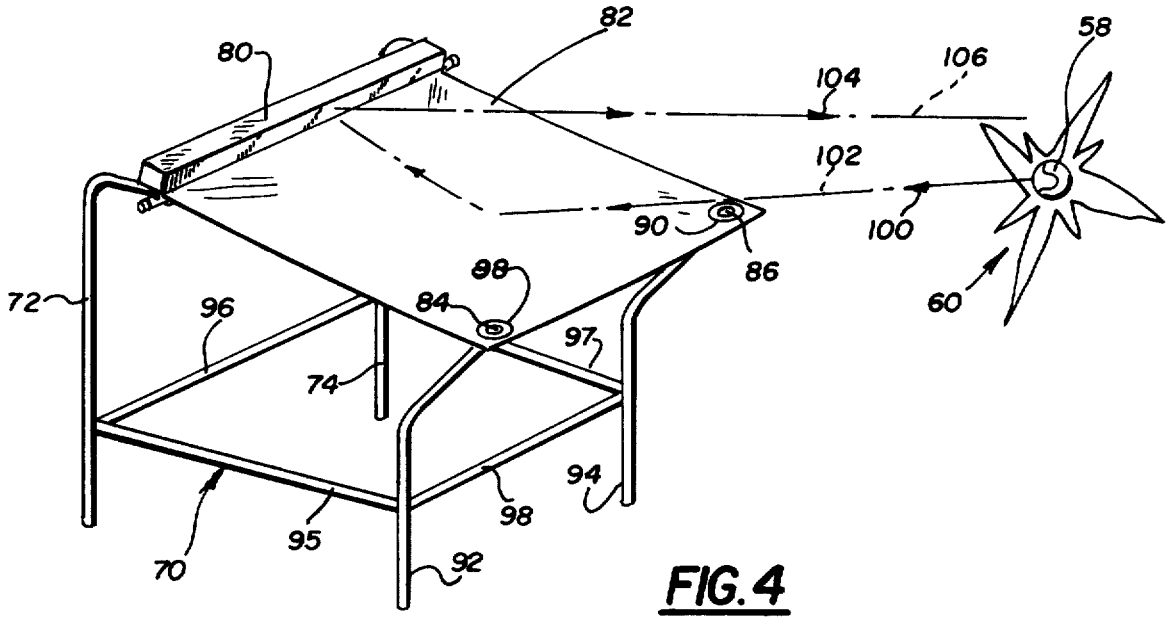
FIG. 4 is a pictorial representation of an embodiment similar to that shown in FIG. 3 with the response time of the ball modified still further.

In the alternative embodiments shown in FIGS. 3 and 4, the frame 70 includes two rear vertical members 72 and 74 which are provided with curved portions 76 and 78 at the upper ends thereof. A rebound surface 80 having a flexible material 82 affixed thereon is affixed at the distal ends of the curved portions 76 and 78 in a conventional manner. The other end of flexible material is provided with a pair of eyelets 84 and 86 which are placed over retaining pegs 88 and 90 provided in the two forward vertical members 92 and 94 of the frame 70. The forward vertical members 92 and 94 are rigidly affixed to the rearward vertical members 72 and 74 by means of horizontal support members 95, 96, 97 and 98 thereby forming a rigid frame whose support pieces provide a different angle of incline of the flexible member 82. Flexible member 82 is maintained in a relatively taut position when the eyelets 84 and 86 of the flexible material 82 is retained by the pegs 88 and 89 at the end of vertical members 92 and 94.

A ball struck by a racket at impact point 60 will follow the direction of arrow 100 and follow the path 102 shown by the broken line. As shown the ball will strike or impinge upon the flexible material 82 and have its major portion of momentum absorbed thereby and be caused to move in an upwardly direction towards the rebound surface 80 whereupon it will be deflected outwardly in the direction of arrow 104 following path 106 where it may be struck by an individual again. Thereby an individual may keep the ball in play and thus continue to practice and improve his form and skill.

Figure 5:
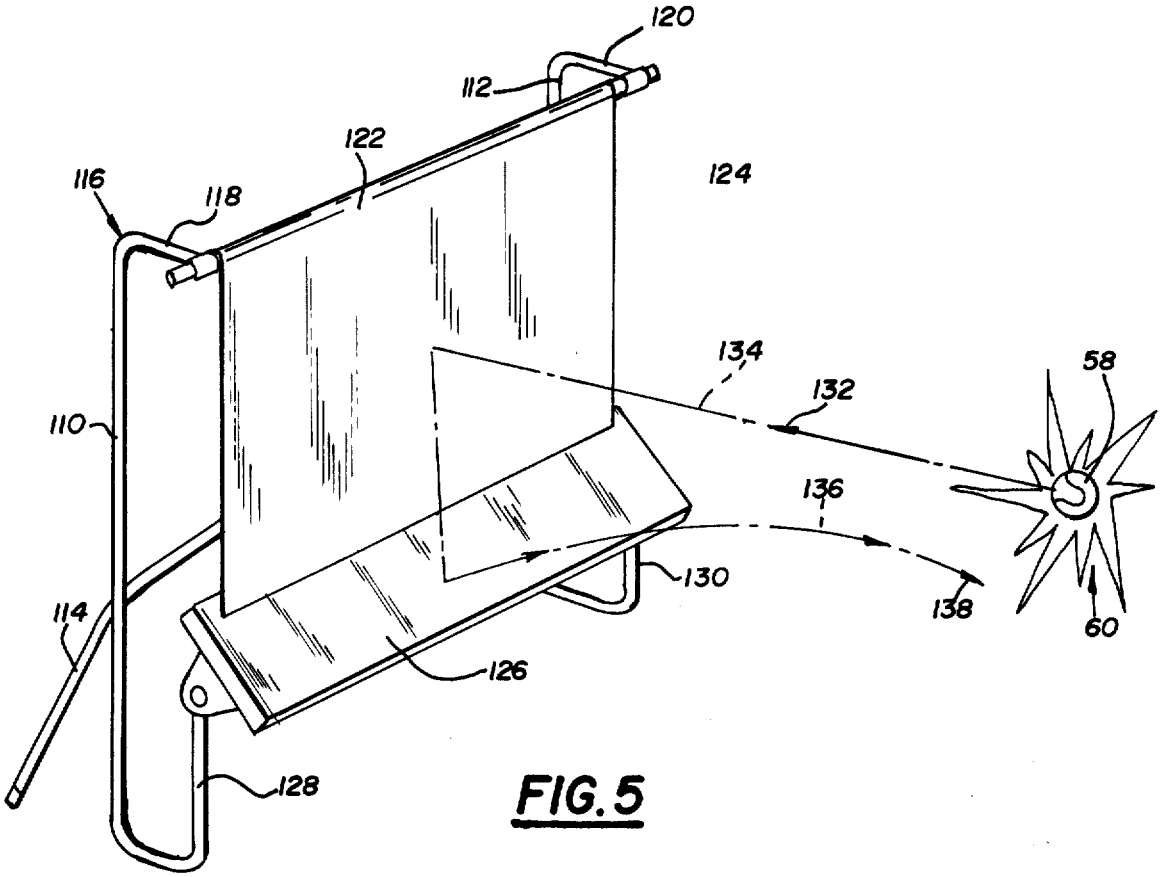
FIG. 5 is yet another alternative embodiment incorporating the principles of the present invention.

An alternate embodiment is shown in FIG. 5 wherein the front and rear vertical members are fabricated in a unitary piece 110 and 112 and has therebetween a reinforcing member 114 which functions to maintain members 110 and 112 in a rigid fixed position while providing the angle support member so that the frame 116 is maintained at the desired angle. A curved portion 118 and 120 is provided at the upper end of members 110 and 112. A support member 122 has a flexible member 124 affixed thereon in a conventional manner and is affixed to the distal ends of curved portions 118 and 120 of vertical members 110 and 112.

The flexible member 124 extends downwardly where it terminates in a rebound surface 126 which is rotatably mounted, in a conventional manner, to the upper end of the vertical portion 128 and 130 of members 110 and 112. By adjusting the angle of rebound member 126 the path of the return ball 58 can be controlled.

Striking ball 58 at impact point 60 causes the ball to move in the direction of arrow 132 following the broken line path 134 until it impacts the flexible member 124 wherein the flexible member absorbs the kenetic energy imparted to the ball when it is hit by a racket (not shown) and thereby causes the ball 58 to fall in a downwardly direction and strike rebound surface 126. Upon hitting rebound surface 126 the ball will follow path 136 and move in the direction of arrow 138 where it returns to the general area of the impact point so that an individual may keep the ball in continuous play.

It is to be noted that in this embodiment as well as the others that a major portion of the kenetic energy is absorbed at the point of impact with the flexible material. The rebound surface generally provides for the angle of return of the ball to the initial impact point, where the ball is struck by the racket.

Figure 6:
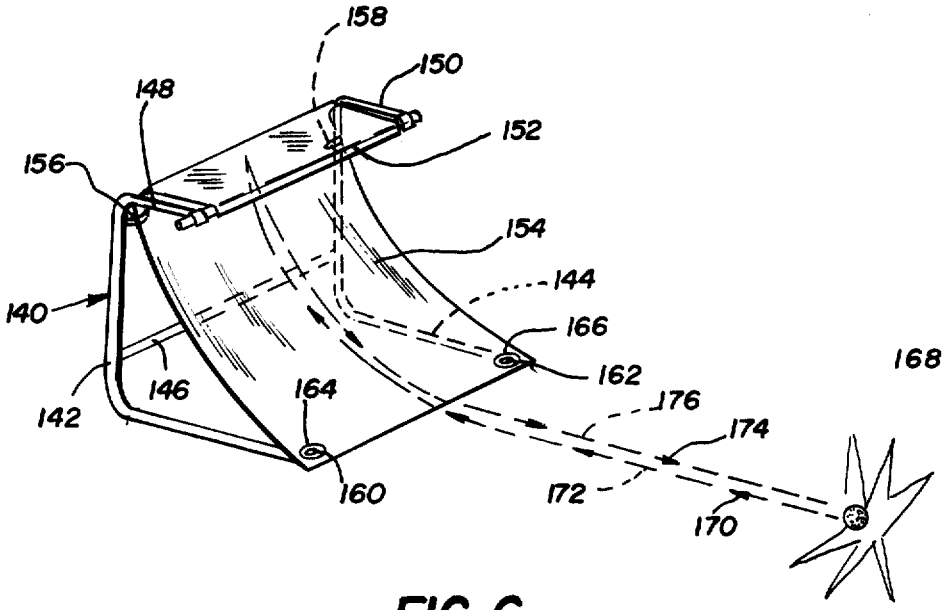
FIG. 6 is yet a further alternative embodiment of the present invention.

In the embodiment shown in FIG. 6 the frame 140 is also manufactured from a tubular U-shaped member 142 and 144 which is reinforced and held in position by horizontal member 146. A curved portion 148 and 150 is provided on the upper portion of members 142 and 144 with the distal ends being adapted to receive rebound member 152 which has affixed therein a flexible material 154. A retaining member 156 and 158 is used to maintain flexible member 154 in a rearward most position to provide an absorbing means for the kenetic energy imparted to a ball. The flexible member 154 is extended in a downwardly direction where it is retained on retaining pegs 160 and 162 which are adapted to receive eyelets 164 and 166 provided in the corners of flexible material 154. Striking a ball 168 such as a golf ball toward the frame 140 which is disposed upon the ground and cause the golf ball to move in the direction of arrow 170 along the path 172 where it can strike the rebound surface 152 wherein it will return in the direction of arrow 174 and path 176. Thus, an individual wanting to practice golf strokes may readily use an apparatus as disclosed herein.

Figure 7:
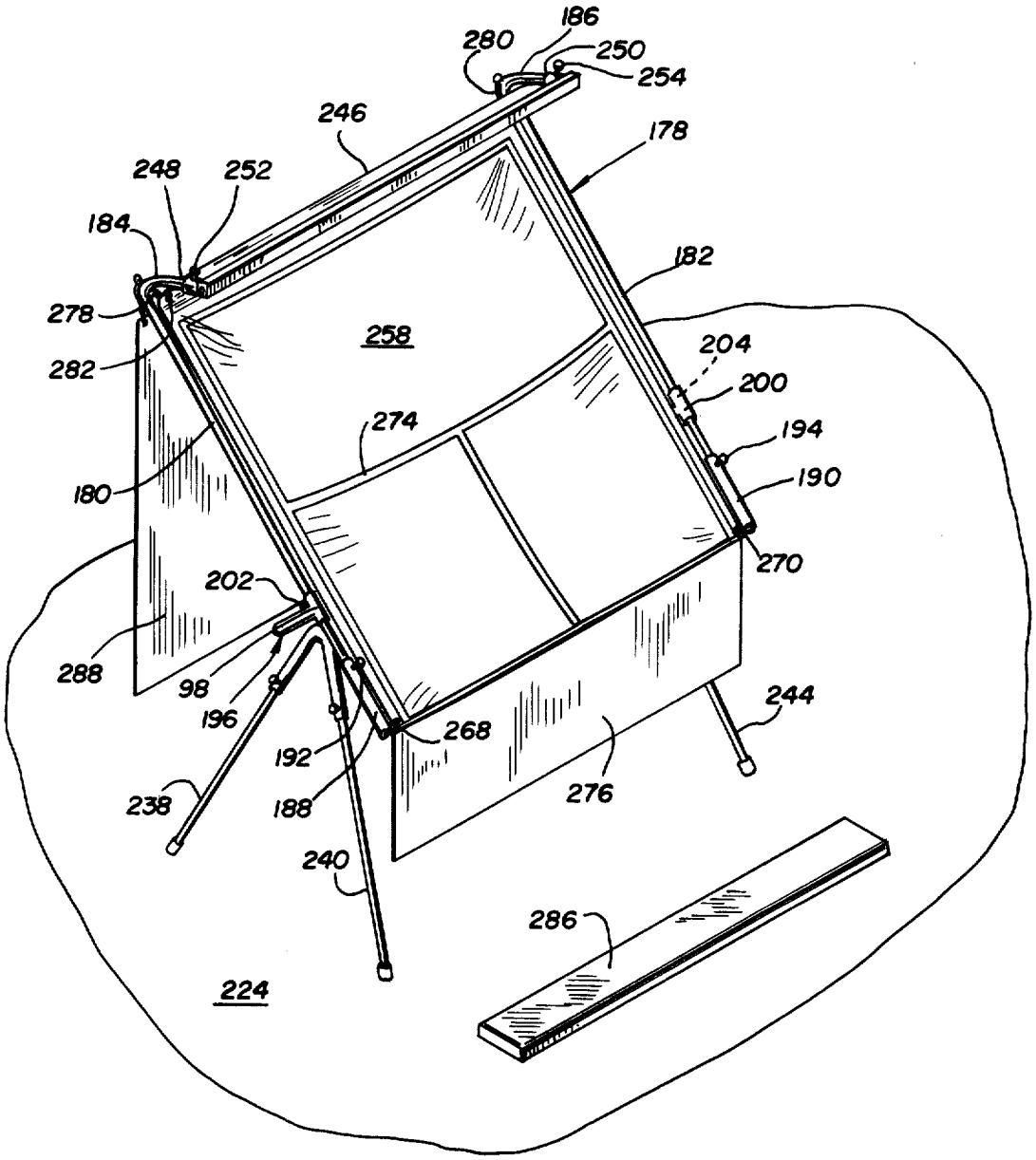
FIG. 7 is yet another alternative embodiment of the present invention with an adjustable frame capable of providing a plurality of response times and deflection angles to a ball impinging thereon.

A still further embodiment of the training apparatus according to the principles of the present invention is disclosed in FIG. 7. The apparatus 10 includes a tubular frame member 180 and 182 which are provided with a curved portion 184 and 186, respectively, at the upper ends thereof. The lower end of members 180 and 182 is provided with a telescoping member 188 and 190, respectively, which permits the length of the frame to be extended in the longitudinal direction as will be explained hereinafter. The telescoping members 188 and 190 are provided with thumb screws 192 and 194 which enables the telescoping members to be tightened in its fully extended position. Preferably the frame members 180 and 182 are fabricated of tubular material. A U-shaped cross member 196 rigidly supports members 180 and 182 in a hollow tubular portion 198 and 200 provided at the distal ends thereof. The hollow tubular portion is provided with thumb screws 202 and 204 to enable the members 180 and 182 to be fixed in position (see FIG. 8).

Figures 8, 8A:
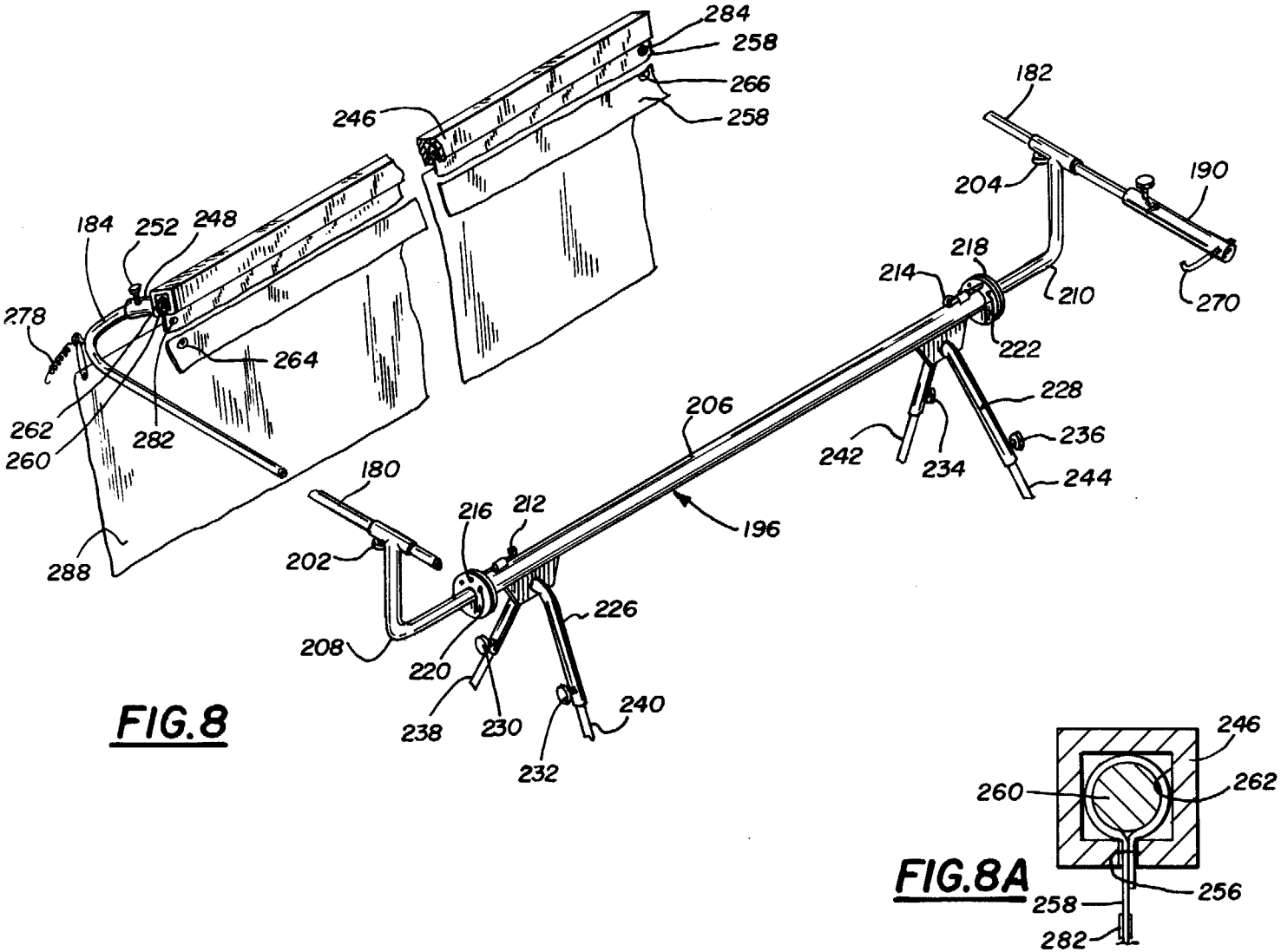
FIG. 8 is an enlarged isometric view of the support portion of the adjustable frame utilizing the embodiment of FIG. 7.
FIG. 8A is a cross sectional view in elevation of the preferred means of affixing a flexible member to the rebound surface.

The cross member is preferably fabricated in three portions, a central portion 206 and a pair of end portions 208 and 210 as shown in enlarged detail in FIG. 8. The end portions 208 and 210 are rotatably fixed to the central portion 206 in a conventional manner. The ends of the central portion 206 are provided with a spring loaded detent mechanism 212 and 214 which is adapted to cooperate with a disc-shaped portion 216 and 218 that has dispersed proximate the circumference thereof a plurality of holes 220 and 222 which coooperates with the detent mechanism to permit the members 180 and 182 to be disposed at various angles relative to the horizontal ground support surface 224 on which the training apparatus is mounted.

An inverted V-shaped member 226 and 228 is affixed, preferably by welding, to the central portion 206 of the cross member 196. The ends of members 226 and 228 have hollow ends therein and are provided with thumb screws 230, 232, 234, and 236 so that they may readily retain legs 238, 240 and 242 therein. These legs may be made adjustable. Thus, the support portion of the frame is capable of maintaining the frame at a plurality of angles from the horizontal depending on the position of the detent mechanisms 212 and 214.

A rebound surface 246 extends horizontally across the width of the frame 178 and is preferably affixed to the distal ends of curved portions 184 and 186 of frame members 180 and 182 by means of a hollow tubular shaped portion 248 and 250 which fits over curved portions 184 and 186 and is held thereto by means of thumb screws 252 and 254. Portions 248 and 250 are preferably welded to the rebound surface 246 which is preferably made from a hollow rectangular shaped tube which is slit longitudinally along one surface. (See FIG. 8A) The slit 256 is preferably made thick enough to receive the flexible material 258 therein. The flexible material is folded over and stitched or welded back on itself providing a looped portion 262. A rod 260 is inserted in the looped portion 262 and then the rod and loop portion is slipped into the open area of the rebound surface retaining it therein. The flexible material 258 is permitting to extend loosely across the width of the frame. At the corners of the flexible material a pair of eyelets 264 and 266 are provided. The eyelets 264 and 266 cooperate with hooked retaining members 268 and 270 provided in the ends of telescoping members 188 and 190. Adjusting telescoping members 188 and 190 are adjusted to their full extent causing the flexible member 258 to be maintained in a relatively taut position.

The flexible material may be provided with indicia 274 thereon to simulate the normal markings found on a playing court. By forcing an individual to return the ball to an area as indicated on the flexible material, his accuracy will be improved and when transferring his skills to a playing court he will find that the return strokes are generally directed to the same limited area as defined by the indicia on the flexible material.

The flexible material 258 is provided with an extending portion 276 which extends downwardly toward the support surface and fills the space between the end of the frame and the support surface so that a ball when hit improperly will be deflected downwardly and not be required to be chased long distances.

Proximate the curved portions 184 and 186 of frame members 180 and 182 a retaining device 278 and 280, suitably a spring member, is affixed. The retaining device 278 and 280 cooperate with eyelets 282 and 284 to pull the flexible member rearwardly to form an overhanging portion which cooperates with the rebound surface. Thus, a ball striking the flexible member 258 will have its kenetic energy mostly absorbed thereby and will be caused to move upwardly moving around the curved portion of the flexible member where it can strike the rebound surface 246 whereupon it will slowly move down the flexible material leaving the end thereof and striking a second rebound surface 286, suitably a wooden plank or a hard support surface, which is also used to support the training apparatus. A ball striking this second rebound surface will bounce upwardly toward the individual that sent the ball toward the training apparatus. Thus, the ball may be kept in continual motion as explained in the earlier embodiments.

A wind screen or shield 288 is affixed by any conventional means such as an eyelet and string to the curved portion 184 and 186 of frame members 180 and 182. The wind shield hangs downwardly deflecting any wind from impinging upon the rear or backside of flexible material 258 thereby preventing the loosely fitting flexible material from moving forward and causing a ball thereon not to have its kenetic energy absorbed thereby. Thus, the present invention may be readily utilized both indoors and outdoors.

Figure 9:
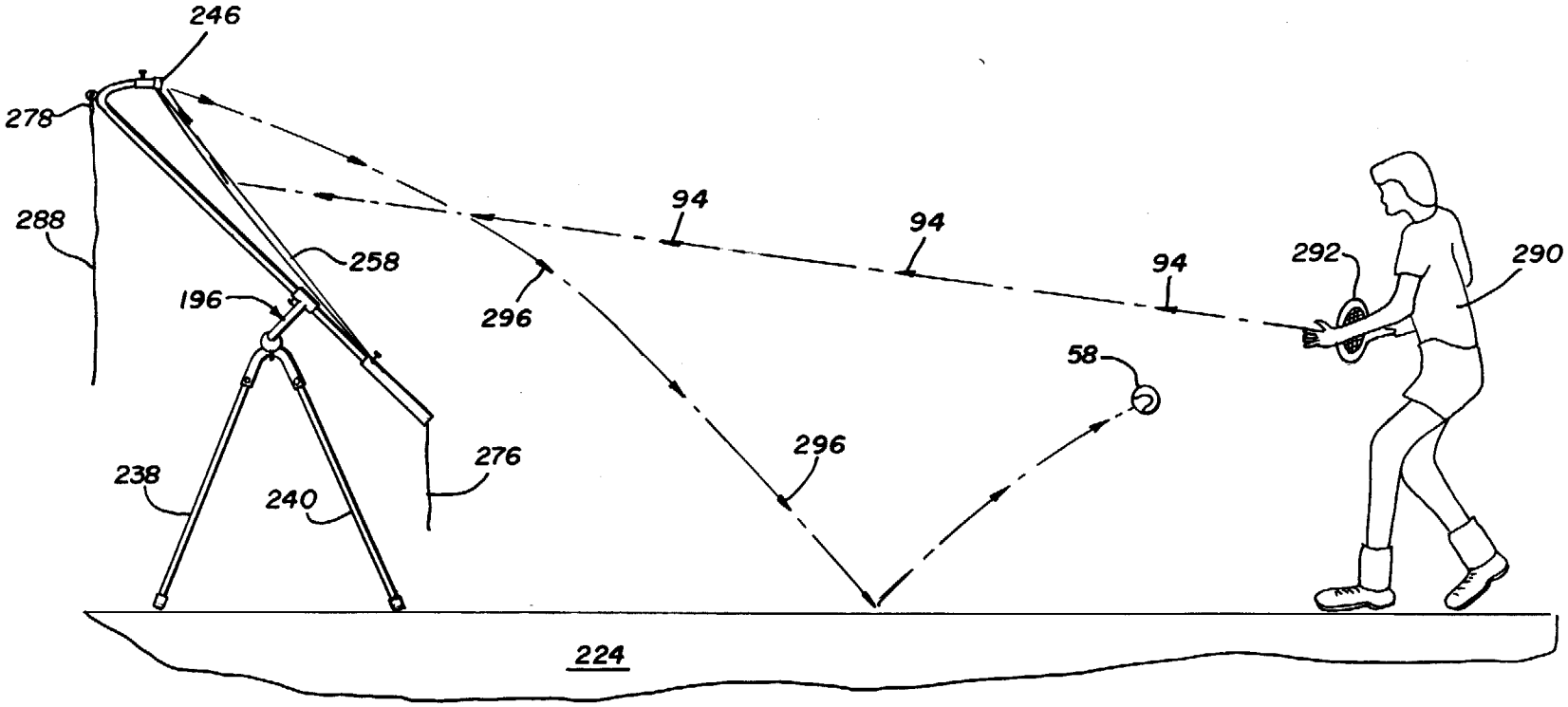
FIG. 9 is a pictorial representation of a training apparatus in its fully extended position utilized by an individual for improving his forehand and backhand strokes.

When the training apparatus is utilized in a small confined area, the retaining device 278 and 280 is connected to eyelets 282 and 284, thus requiring the telescoping portions 188 and 190 of members 180 and 182 to be placed in its shortest or most upwardly position and affixed therein. When the training apparatus is used without the retaining the devices telescoping portions are extended as far as possible causing the flexible member 258 to become taut as is shown in FIG. 9. The training apparatus is shown tilted in its most forward detent position in which an individual 290 striking a ball, preferably a tennis ball 58, with a racket 292 will follow the path shown by arrows 94 until it impinges upon flexible material 258 whereupon it moves to an upward direction until it strikes rebound surface 246 whereupon it follows the path shown by arrows 296 until it rebounds off the support surface 224 and returns to the vicinity of the individual 290 that struck the ball, thereby permitting him to repeat his action and continue the ball in motion, thus giving him practice in returning the tennis ball. The ball when it impinges upon the flexible material will lose most of its kenetic energy and will be delayed in time as it moves upwardly toward the rebound surface 246. The time it takes to return to the individual will approximate the time it would take on a regular court for a second player to return the ball hit to him, thereby providing an individual with a proper time relationship and permitting him to adjust in the same amount of time that would normally occur while playing on a regulation court. This enables an individual to practice both his forehand and backhand each time positioning himself in the correct position.

Figure 10:
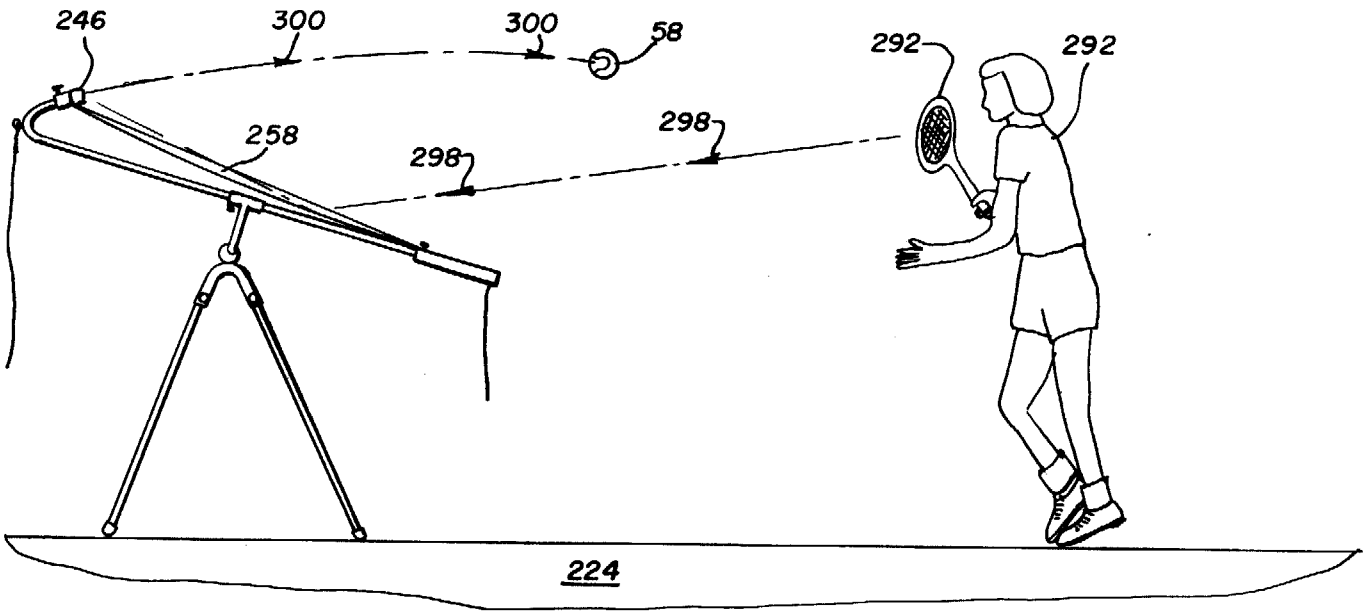
FIG. 10 is a pictorial representation of the apparatus of the instant invention fully extended for use with an individual practicing his normal volley strokes.

FIG. 10 shows the training apparatus in a second position which permits an individual 290 to strike a ball 58 with a racket 292 toward the training apparatus. The ball will follow the path shown by arrows 298 where it will impinge upon the flexible material 258 with the majority of its kenetic energy absorbed thereby. It will then move upwardly and strike rebound surface 246 and be deflected toward the individual in the path shown by arrows 300. Here again, an individual can keep the ball returning to the training apparatus and enables an individual to practice a volley which would occur when playing on a conventional court.

Figure 11:
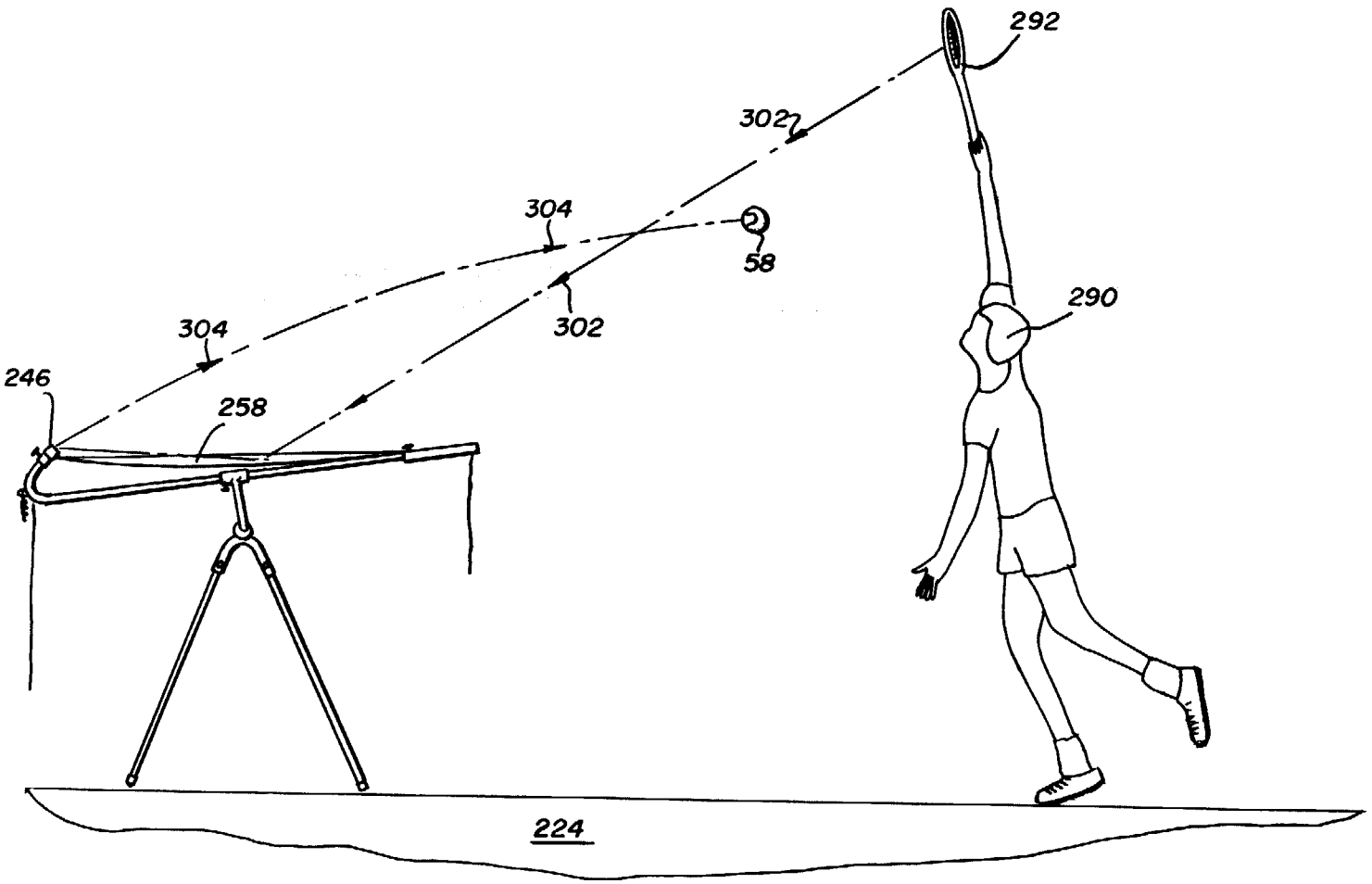
FIG. 11 is a pictorial representation of the apparatus fully extended with an individual practicing his serve and smash strokes.

FIG. 11 shows the training apparatus in its third detent position wherein an individual 290 may strike a tennis ball 58 with a racket 292 causing the ball to travel in a path shown by arrows 302 until it impinges upon the flexible material 258 where it travels towards the rebound surface 246 wherein the ball will rebound along the path shown by arrows 304 toward the individual that imparted the energy to the ball initially. Thus, an individual may practice his serve and smash and practice his return of his serve thereby improving his skill.

It is to be noted that the function of the curved portions 184 and 186 may be accomplished by substantially straight elements pivotally connected to the tubular members 180 and 182 of the frame by a conventional pivoting means wherein the pivots may be locked to maintain the straight elements at the desired angle equivalent to the curved portions 184 and 186.

Hereinbefore has been disclosed a training apparatus for racket sports which may be utilized in a relatively confined area. The apparatus may be utilized by an individual to keep a tennis ball or the like in continuous motion by striking it toward the training apparatus and returning it thereto time after time improving his form, ability, stamina and general agility. It should be understood that various changes in the details, materials, arrangement of parts and operating conditions which have been herein described and illustrated in order to explain the nature of the invention may be made by those skilled in the art within the principles and scope of the invention.

Having thus set forth the nature of the invention, what is claimed is:

1. A training apparatus for racket sports such as tennis, squash, or the like comprising:

(a) elongated frame means having two mutually parallel frame members each having upper, upper distal and lower ends, and a principal segment between said upper and lower ends, said members being curved at their upper ends;

(b) a rigid rebound surface disposed across the width of said frame means at the upper distal ends of said frame members, said rebound surface being spaced vertically apart from and substantially parallel to a plane joining said principle segments;

(c) a flexible material, having upper and lower edges and longitudinal edges perpendicular thereto, attached to said rigid rebound surface, extending loosely across the width of said frame, said flexible material being relatively taut along the length of said frame and attached to the lower ends of said frame members, said upper edge being disposed rearwardly of said lower edge;

(d) horizontal support means connected to said frame means;

(e) means disposing said frame means and thus the said flexible material at diffrent angles to said horizontal support means;

whereby the kinetic energy of a ball struck against the flexible material will be partially absorbed, the ball caused to run upwardly and rearwardly and hit the rigid rebound surface and be deflected downwardly backby said rebound surface towards the player.

2. A training apparatus according to claim 1 further including a second rebound surface horizontally disposed a predetermined distance from said frame and extending the width thereof.

3. A training apparatus according to claim 1 wherein said frame includes a pair of retaining means each having two ends, having one of said ends thereof disposed on the said frame proximate to said curved end, the other end of said retaining means being removably affixed to said flexible material for retaining the longitudinal edges of said material close to the frame member to which said edge is adjacent.

4. A training apparatus according to claim 1 wherein said frame comprises:

a. said two frame members being tubular, each tubular member having a telescoping member received therein, said telescoping member being movable to adjust the length of said frame;

b. a generally U-shaped cross member having means disposed on the distal ends thereof for supporting said tubular members in parallel alignment; and c. said horizontal support means comprising a support portion affixed to said U-shaped cross member, said support portion maintaining said frame a predetermined distance above a support surface.

5. A training apparatus according to claim 4 wherein said cross member includes:

(i) a central portion, (ii) a pair of end portions rotatably affixed to the ends of said central portion, and (iii) means for retaining said end portions in a fixed position relative to said central portion.

6. A training apparatus according to claim 4 wherein said support portion is adjustable for providing different distances above said support surface.

7. A training apparatus according to claim 1 wherein said flexible material is a canvas cloth.

8. A training apparatus according to claim 1 wherein said flexible material includes indicia thereon representing the field of play of said sport.

9. A training apparatus according to claim 1 further including a wind shield means affixed on said frame proximate said curved ends, said wind shield extending downwardly behind said flexible material in order to prevent the wind from impinging upon the rear of said flexible material.

10. A training apparatus according to claim 1 wherein said flexible material is provided with an extending portion which extends beyond the lower end of said frame for filling the space from the lower end of said frame to a support surface.

11. An apparatus of claim 1 wherein said mutually parallel frame members are adjustable in length and the longitudinal tautness of said flexible material is adjustable by adjusting the lengths of said frame members.

* * * * *